US005906563A

United States Patent [19]

Pittari

[11] Patent Number: 5,906,563

[45] Date of Patent: May 25, 1999

[54] DUAL EXERCISE BIKE

[76] Inventor: Dominic Pittari, 39 Imperial Park Dr., Middletown, N.Y. 10941

[21] Appl. No.: 08/996,331

[22] Filed: Dec. 22, 1997

[51] Int. Cl.[6] ..... A63B 21/00

[52] U.S. Cl. ..... 482/62; 482/57

[58] Field of Search ..... 482/51, 57, 62, 482/63, 64, 148; D21/668, 690–691

[56] References Cited

U.S. PATENT DOCUMENTS

| | | | |
|---|---|---|---|
| 4,071,235 | 1/1978 | Zent | 482/57 |
| 4,402,502 | 9/1983 | Peters | 482/62 |
| 4,423,863 | 1/1984 | Figueroa | 482/62 |
| 4,436,097 | 3/1984 | Cunningham . | |
| 4,618,141 | 10/1986 | Ashworth, Jr. . | |
| 4,705,269 | 11/1987 | DeBoer et al. . | |
| 5,256,117 | 10/1993 | Potts | 482/62 |
| 5,284,462 | 2/1994 | Olschansky et al. | 482/64 |
| 5,342,262 | 8/1994 | Hansen | 482/62 |
| 5,580,338 | 12/1996 | Scelta et al. | 482/62 |
| 5,595,557 | 1/1997 | Lambert, Sr. et al. | 482/62 |

*Primary Examiner*—Stephen R. Crow
*Attorney, Agent, or Firm*—Michael I. Kroll

[57] ABSTRACT

A dual exercise bike (10) comprising a frame (12) to support a person thereon. A facility (14) is carried on the frame (12), for exercising the arms of the person with a manual rotatable movement. A facility (16) is carried on the frame (12), for exercising the legs of the person with a manual rotatable movement. A structure (18) in the frame (12) is for adjusting resistance of the manual rotatable movement of the first exercising facility (14), when the arms of the person are to be exercised. A structure (20) in the frame (12) is for adjusting resistance of the manual rotatable movement of the second exercising facility (16), when the legs of the person are to be exercised.

16 Claims, 3 Drawing Sheets

42
14
38
40
40
54
10
64
62
24
50
60
76
20
74
28
16
44
3
82
68
3
56
66
70
72
18
58
80
48
52
12
46
50
22

DUAL EXERCISE BIKE

BACKGROUND OF THE INVENTION

1. Field of the Invention

The instant invention relates generally to stationary exercise cycles and more specifically it relates to a dual exercise bike. The dual exercise bike will simultaneously exercise the arms and legs of a person sitting upon a seat, by rotating handgrips and foot pedals having flywheels.

2. Description of the Prior Art

Numerous stationary exercise cycles have been provided in prior art. For example, U.S. Pat. Nos. 4,071,235 to Zent; 4,436,097 to Cunningham; 4,618,141 to Ashworth, Jr. and 4,705,269 to DeBoer et al. all are illustrative of such prior art. While these units may be suitable for the particular purpose to which they address, they would not be as suitable for the purposes of the present invention as heretofore described.

ZENT, LAWSON J.

ADJUSTABLE RESISTANCE EXERCISING APPARATUS

U.S. Pat. No. 4,071,235

A frame having a base and two horizontally spaced substantially upright elongate posts, a first of which carries a saddle seat. Mounted for rotation on the second post is a foot pedal spindle carrying first and second sprocket wheels. Also mounted for rotation on the second post is a disc spindle carrying a disc and a sprocket wheel. Mounted for rotation near the top of the second post is a hand crank spindle carrying a sprocket wheel. A drive chain is entrained over the disc sprocket wheel and the first foot pedal sprocket wheel. A second chain is entrained over the handle bar sprocket wheel and the second foot pedal sprocket wheel, which sprocket wheels are designed to provide predetermined different angular speeds to their respective spindles. A manually operable pointer is rotatably mounted on the second post to vary the spacing between two brake pads mounted on either side of the disc to provide a variable braking force to the disc corresponding to such spacing.

CUNNINGHAM, PATRICK J.

CARDIOVASCULAR EXERCISE APPARATUS

U.S. Pat. No. 4,436,097

A cardiovascular exercise apparatus is disclosed comprising a support frame adapted to carry a user thereon including a pair of separate means for providing aerobic exercising of both the upper and lower body portions of the user. Both of the exercising means are governed by a hydraulic motor/regulator which applies a preset, variable exercise load or torque to the exercising means. Biofeedback means are additionally provided to monitor the heart rate of the user during the exercise and control the hydraulic regulator to reduce and/or terminate the exercise load in response to the user's heart rate exceeding a preset limit for the particular exercise time period.

ASHWORTH, JR., THOMAS

THERAPEUTIC EXERCISE DEVICE

U.S. Pat. No. 4,618,141

A therapeutic exercise device mounted on a floor base having a bicycle type seat, hand cranks and foot pedals. The foot pedals turn a lower rotatable shaft equipped with a pair of identical sprockets. Each hand crank turns a rotatably interconnected portion of a split upper shaft, each of the split shaft portions equipped with a sprocket. The sprocket on one split shaft portion is slightly larger than a lower shaft sprocket, and the sprocket on the other split shaft portion is slightly smaller than a lower shaft sprocket.

A pair of drive chains interconnect the upper and lower sprockets.

DeBOER, WILLIAM M.

DeBOER, JR., STANLEY E.

HYKES, ROBERT C.

EXERCISE APPARATUS

U.S. Pat. No. 4,705,269

An exercise apparatus including upper and lower body exercising assemblies which are operable in isolation or in conjunction with each other. The upper body assembly includes rotary handle members which rotate a driving sprocket. The upper driving sprocket in turn rotates an upper driven sprocket which is connected via two additional sprockets and an endless chain to the wheel of the lower body exercising assembly. The lower body assembly is a conventional exercise bicycle including rotary foot pedals for rotating a lower driving sprocket which in turn rotates a lower driven sprocket connected to the wheel. The upper and lower driven sprockets are one-directional ratcheted sprockets which can be rotated only by the endless chain joining them to the upper and lower driving sprockets, respectively, to provide the independent operation of the upper and lower body exercising assemblies.

SUMMARY OF THE INVENTION

A primary object of the present invention is to provide a dual exercise bike that will overcome the shortcomings of the prior art devices.

Another object is to provide a dual exercise bike that will simultaneously exercise the arms and legs of a person sitting upon a seat, by rotating handgrips and foot pedals having flywheels.

An additional object is to provide a dual exercise bike in which the rotating handgrips and foot pedals can be adjusted by using two separate gearshift levers on two separate transmissions that are manually controlled by the person sitting upon the seat.

A further object is to provide a dual exercise bike that is simple and easy to use.

A still further object is to provide a dual exercise bike that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
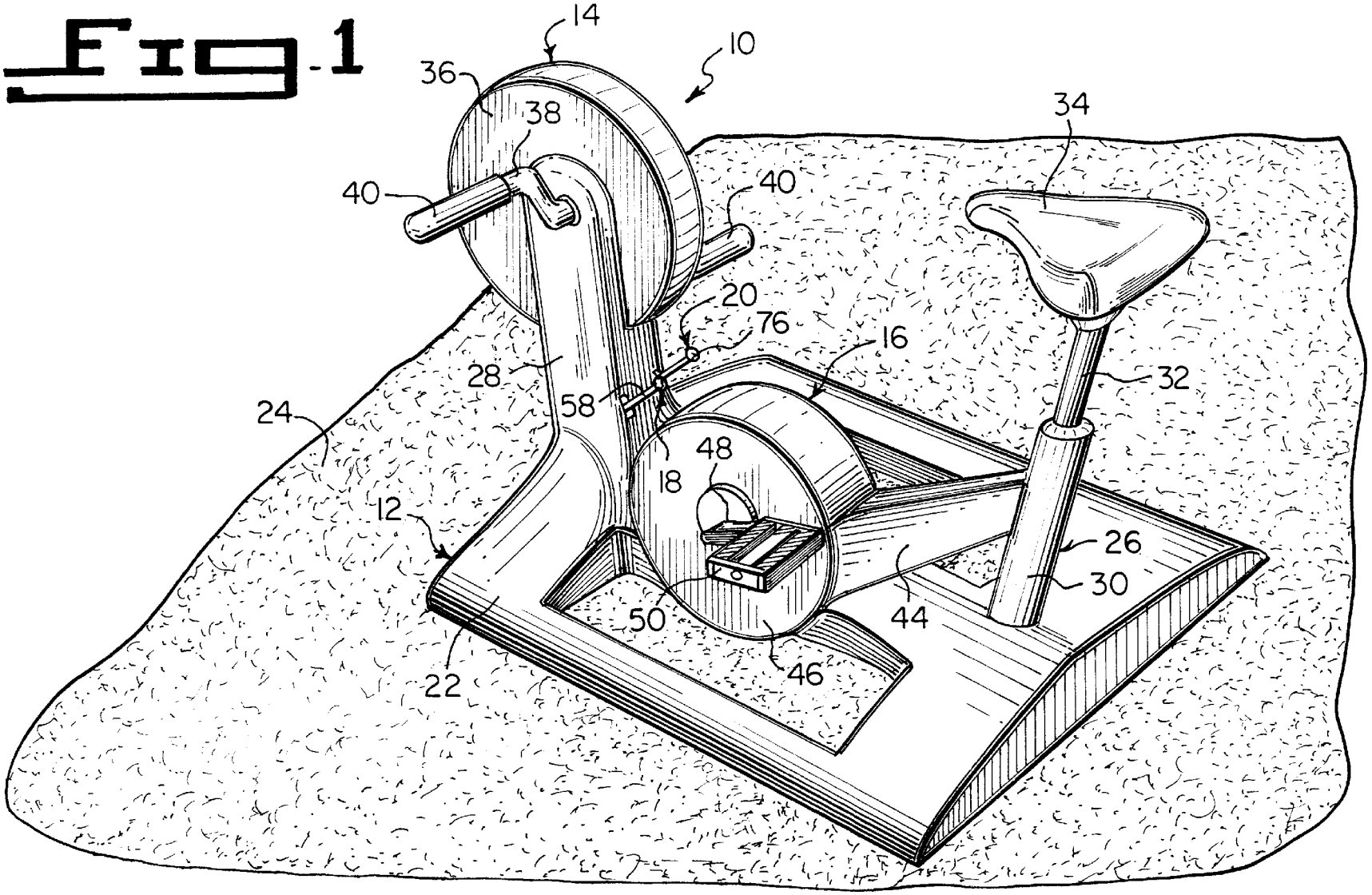
FIG. 1 is a perspective view of the present invention.
Figure 2:
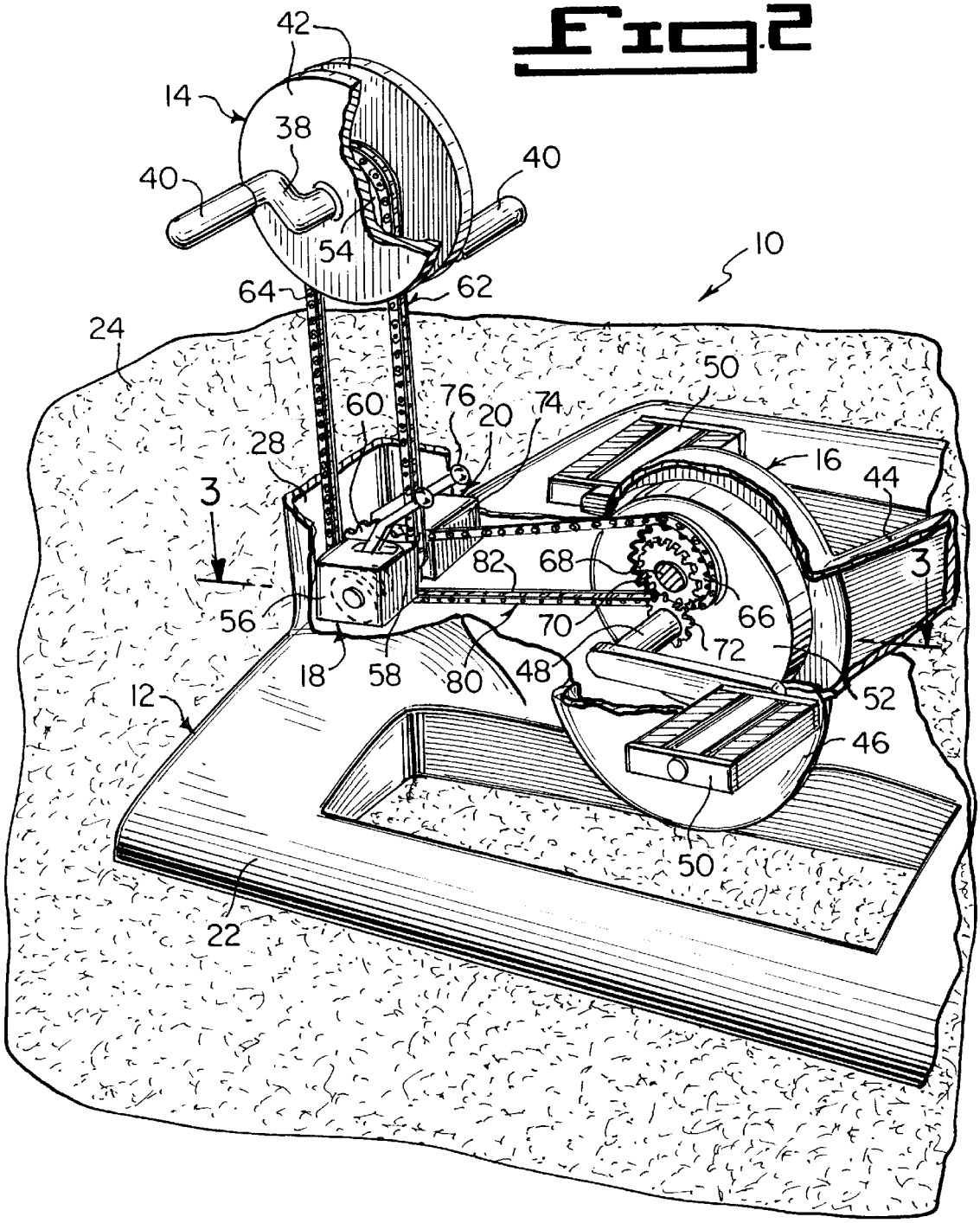
FIG. 2 is a perspective view similar to FIG. 1, with parts broken away and in section, showing the chain linkage and drive mechanism therein.
Figure 3:
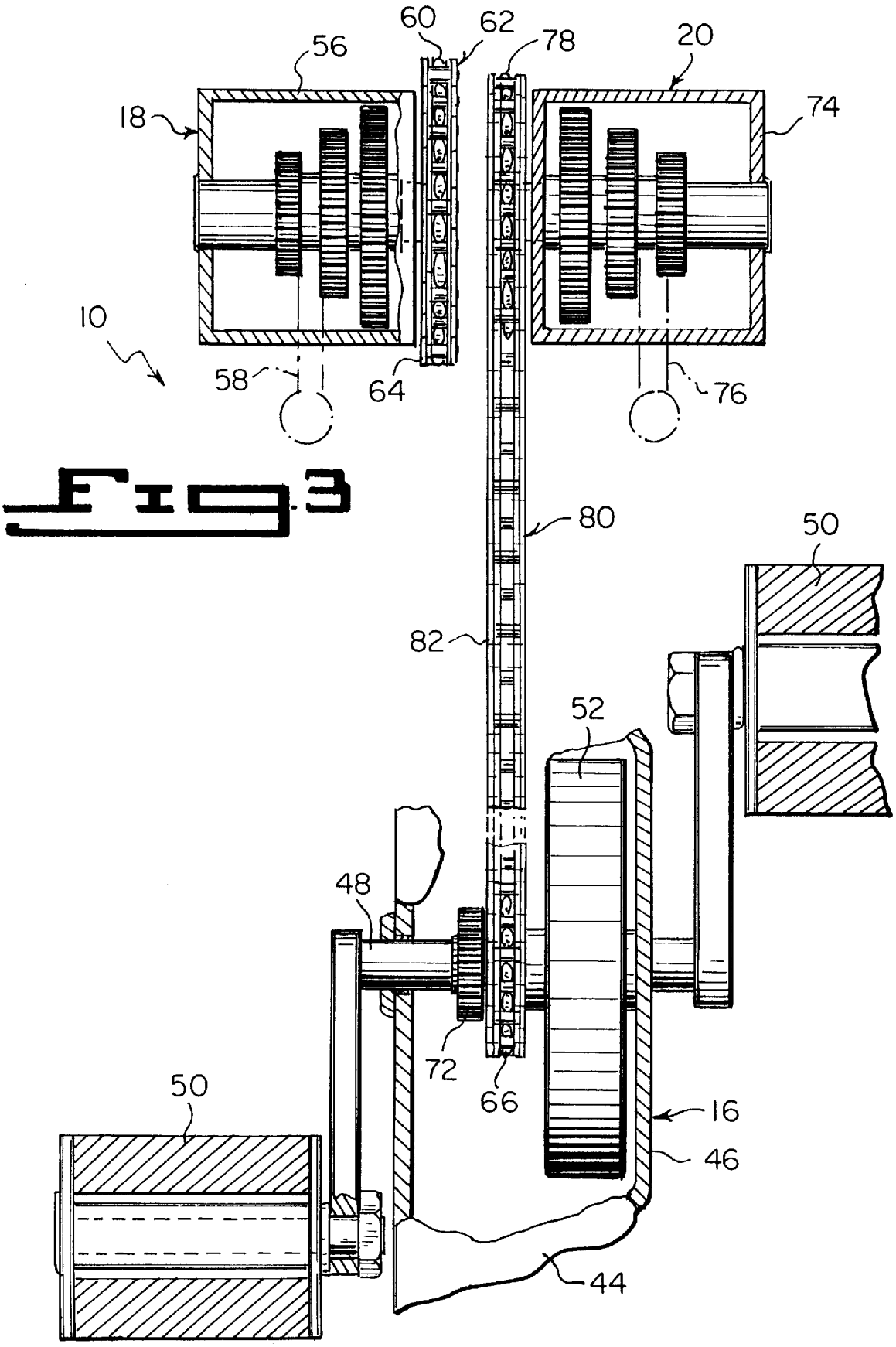
FIG. 3 is an enlarged cross sectional view taken generally along line 3—3 in FIG. 2.

Turning now descriptively to the drawings, in which similar reference characters denote similar elements throughout the several views, FIGS. 1 through 3 illustrate the present invention being a dual exercise bike 10. With regard to the reference numerals used, the following numbering is used throughout the various drawing figures.

10 dual exercise bike
12 frame of 10
14 first exercising facility of 10
16 second exercising facility of 10
18 first resistance adjusting structure of 10
20 second resistance adjusting structure of 10
22 base of 12
24 support surface
26 seat assembly of 12 on 22
28 hollow column of 12 on 22
30 seat tube of 26 on 22
32 seat post of 26 in 30
34 bicycle type seat of 26 on 32
36 cylindrical casing of 14 in 28
38 hand crank of 14 in 36
40 handgrip of 14 on 38
42 flywheel of 14 on 38
44 hollow cross bar member of 16 between 26 and 28
46 cylindrical housing of 16 in 44
48 foot crank of 16 in 46
50 foot pedal of 16 on 48
52 flywheel of 16 on 48
54 first sprocket wheel of 18 on 38
56 transmission unit of 18 in 28
58 gearshift lever of 18 on 56
60 second sprocket wheel of 18 on 56
62 operatively connecting component of 18
64 endless chain for 62
66 first sprocket wheel of 20
68 shaft of 66 in 46
70 first gear of 20 on 68
72 second smaller gear of 20 on 48
74 transmission unit of 20 in 28
76 gearshift lever of 20 on 74
78 second sprocket wheel of 20
80 operatively connecting component of 20
82 endless chain for 80

The dual exercise bike 10 comprises a frame 12 to support a person thereon. A facility 14 is carried on the frame 12 for exercising the arms of the person with a manual rotatable movement. A facility 16 is carried on the frame 12, for exercising the legs of the person with a manual rotatable movement. A structure 18 in the frame 12 is for adjusting resistance of the manual rotatable movement of the first exercising facility 14, when the arms of the person are to be exercised. A structure 20 in the frame 12 is for adjusting resistance of the manual rotatable movement of the second exercising facility 16, when the legs of the person are to be exercised.

The frame 12 includes a base 22 to rest upon a support surface 24, such as a floor. A seat assembly 26 is connected to the base 22, so that the person can sit upon the seat assembly 26 to exercise the arms and legs. A hollow column 28 extends upwardly from the base 22. The seat assembly 26 consists of a seat tube 30 mounted to and extending upwardly from the base 22. A seat post 32 adjustably fits into the seat tube 30. A bicycle type seat 34 is on the seat post 32.

The first exercising facility 14 comprises a cylindrical casing 36 vertically connected into a top end of the hollow column 28. A hand crank 38 is rotatably mounted through the cylindrical casing 36. A pair of handgrips 40 are provided, in which each handgrip 40 is fitted onto a distal end of the hand crank 38. A pair of flywheels 42 are affixed onto the hand crank 38 within the cylindrical casing 36.

The second exercising facility 16 includes a hollow cross bar member 44 extending outwardly from a side of the seat assembly 26 to the lower end of the hollow column 28. A cylindrical housing 46 is vertically connected into the hollow cross bar member 44. A foot crank 48 is rotatably mounted through the cylindrical housing 46. A pair of foot pedals 50 are provided. Each foot pedal 50 is rotatably attached to a distal end of the foot crank 48. A flywheel 52 is affixed onto the foot crank 48 within the cylindrical housing 46.

The first resistance adjusting structure 18 consists of a first sprocket wheel 54 affixed onto the hand crank 38 between the pair of flywheels 42. A transmission unit 56 is mounted within a lower end of the hollow column 28. A gearshift lever 58 extends from the transmission unit 56 and through the hollow column 28, to be manually operated to control the transmission unit 56. A second sprocket wheel 60 is rotatably connected to the transmission unit 56 within the lower end of the hollow column 28. A component 62 is for operatively connecting the first and second sprocket wheels 54, 60, so that operation of the transmission unit 56 by the gearshift lever 58 will control rotation of the hand crank 38.

The operatively connecting component 62 is an endless chain 64 extending about the first sprocket wheel 54 and the second sprocket wheel 60. The first sprocket wheel 54 is of a one-directional ratchet type, so that the hand crank 38 will only rotate in a forward direction.

The second resistance adjusting structure 20 comprises a first sprocket wheel 66 having a shaft 68 rotatably jointed within the cylindrical housing 46. A first gear 70 is affixed onto the shaft 68 of the first sprocket wheel 66. A second smaller gear 72 is affixed onto the foot crank 48, whereby the second smaller gear 72 is in engagement with the first gear 70. A transmission unit 74 is mounted within the lower end of the hollow column 28. A gearshift lever 76 extends from the transmission unit 74 and through the hollow column 28, to be manually operated to control the transmission unit 74. A second sprocket wheel 78 is rotatably connected to the transmission unit 74 within the lower end of the hollow column 28. A component 80 is for operatively connecting the first and second sprocket wheels 66, 78, so that operation of the transmission unit 74 by the gearshift lever 76 will control rotation of the foot crank 48.

The operatively connecting component 80 is and endless chain 82 extending about the first sprocket wheel 66 and the second sprocket wheel 78. The first sprocket wheel 66 is of a one-directional ratchet type, so that the foot crank 48 will only rotate in a forward direction.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A dual exercise bike comprising:

a) a frame for supporting a person thereon, including:

i) a base to rest upon a support surface;

ii) a seat assembly connected to said base, so that the person can sit upon said seat assembly to exercise the arms and legs; and iii) a hollow column extending upwardly from said base;

b) first means carried on said frame, for exercising the arms of the person with a manual rotatable movement, including:

i) a cylindrical casing vertically connected into a top end of said hollow column ii) a hand crank rotatably mounted through said cylindrical casing;

iii) a pair of handgrips, in which each said handgrip is fitted onto a distal end of said hand crank; and iv) a pair of flywheels affixed onto said hand crank within said cylindrical casing;

c) second means carried on said frame, for exercising the legs of the person with a manual rotatable movement;

d) means in said frame for adjusting resistance of the manual rotatable movement of said first exercising means, when the arms of the person are to be exercised; and e) means in said frame for adjusting resistance of the manual rotatable movement of said second exercising means, when the legs of the person are to be exercised.

2. A dual exercise bike as recited in claim 1, wherein said seat assembly includes:

a) a seat tube mounted to and extending upwardly from said base;

b) a seat post to adjustably fit into said seat tube; and c) a bicycle type seat on said seat post.

3. A dual exercise bike as recited in claim 1, wherein said second exercising means includes:

a) a hollow cross bar member extending outwardly from a side of said seat assembly to the lower end of said hollow column;

b) a cylindrical housing vertically connected into said hollow cross bar member;

c) a foot crank rotatably mounted through said cylindrical housing;

d) a pair of foot pedals, in which each said foot pedal is rotatably attached to a distal end of said foot crank; and e) a flywheel affixed onto said foot crank within said cylindrical housing.

4. A dual exercise bike as recited in claim 1, wherein said first resistance adjusting means includes:

a) a first sprocket wheel affixed onto said hand crank between said pair of flywheels;

b) a transmission unit mounted within a lower end of said hollow column;

c) a gearshift lever extending from said transmission unit and through said hollow column to be manually operated to control said transmission unit;

d) a second sprocket wheel rotatably connected to said transmission unit within the lower end of said hollow column; and e) means for operatively connecting said first and second sprocket wheels, so that operation of said transmission unit by said gearshift lever will control rotation of said hand crank.

5. A dual exercise bike as recited in claim 4, wherein said operatively connecting means is an endless chain extending about said first sprocket wheel and said second sprocket wheel.

6. A dual exercise bike as recited in claim 4, wherein said first sprocket wheel is of a one-directional ratchet type, so that said hand crank will only rotate in a forward direction.

7. A dual exercise bike as recited in claim 3, wherein said second resistance adjusting means includes:

a) a first sprocket wheel having a shaft rotatably mounted within said cylindrical housing;

b) a first gear affixed onto said shaft of said first sprocket wheel;

c) a second smaller gear affixed onto said foot crank, whereby said second smaller gear is in engagement with said first gear;

d) a transmission unit mounted within the lower end of said hollow column;

e) a gearshift lever extending from said transmission unit and through said hollow column to be manually operated to control said transmission unit;

f) a second sprocket wheel rotatably connected to said transmission unit within the lower end of said hollow column; and g) means for operatively connecting said first and second sprocket wheels, so that operation of said transmission unit by said gearshift lever will control rotation of said foot crank.

8. A dual exercise bike as recited in claim 7, wherein said operatively connecting means is an endless chain extending about said first sprocket wheel and said second sprocket wheel.

9. A dual exercise bike as recited in claim 7, wherein said first sprocket wheel is of a one-directional ratchet type, so that said foot crank will only rotate in a forward direction.

10. A dual exercise bike as recited in claim 2, wherein said second exercising means includes:

a) a hollow cross bar member extending outwardly from a side of said seat assembly to the lower end of said hollow column;

b) a cylindrical housing vertically connected into said hollow cross bar member;

c) a foot crank rotatably mounted through said cylindrical housing;

d) a pair of foot pedals, in which each said foot pedal is rotatably attached to a distal end of said foot crank; and e) a flywheel affixed onto said foot crank within said cylindrical housing.

11. A dual exercise bike as recited in claim 10, wherein said first resistance adjusting means includes:

a) a first sprocket wheel affixed onto said hand crank between said pair of flywheels;

b) a transmission unit mounted within a lower end of said hollow column;

c) a gearshift lever extending from said transmission unit and through said hollow column to be manually operated to control said transmission unit;

d) a second sprocket wheel rotatably connected to said transmission unit within the lower end of said hollow column; and e) means for operatively connecting said first and second sprocket wheels, so that operation of said transmission unit by said gearshift lever will control rotation of said hand crank.

12. A dual exercise bike as recited in claim 11, wherein said operatively connecting means is an endless chain extending about said first sprocket wheel and said second sprocket wheel.

13. A dual exercise bike as recited in claim 12, wherein said first sprocket wheel is of a one-directional ratchet type, so that said hand crank will only rotate in a forward direction.

14. A dual exercise bike as recited in claim 13, wherein said second resistance adjusting means includes:

a) a first sprocket wheel having a shaft rotatably mounted within said cylindrical housing;

b) a first gear affixed onto said shaft of said first sprocket wheel;

c) a second smaller gear affixed onto said foot crank, whereby said second smaller gear is in engagement with said first gear;

d) a transmission unit mounted within the lower end of said hollow column;

e) a gearshift lever extending from said transmission unit and through said hollow column to be manually operated to control said transmission unit;

f) a second sprocket wheel rotatably connected to said transmission unit within the lower end of said hollow column; and g) means for operatively connecting said first and second sprocket wheels, so that operation of said transmission unit by said gearshift lever will control rotation of said foot crank.

15. A dual exercise bike as recited in claim 14, wherein said operatively connecting means is an endless chain extending about said first sprocket wheel and said second sprocket wheel.

16. A dual exercise bike as recited in claim 15, wherein said first sprocket wheel is of a one-directional ratchet type, so that said foot crank will only rotate in a forward direction.

* * * * *